United States Patent [19]

Thome

[11] 4,221,612

[45] Sep. 9, 1980

[54] GRINDING MEMBERS

[75] Inventor: Michel Thome, Nouzonville, France

[73] Assignee: Acieries Thomé Cromback, Paris, France

[21] Appl. No.: 951,107

[22] Filed: Oct. 13, 1978

[30] Foreign Application Priority Data

Oct. 14, 1977 [FR] France ..... 77 31045

[51] Int. Cl.[2] ..... C21D 7/14

[52] U.S. Cl. ..... 148/35; 75/123 CB; 148/138; 148/141

[58] Field of Search ..... 148/35, 138, 12 R, 12.4, 148/2, 141; 75/123 CB

[56] References Cited

U.S. PATENT DOCUMENTS

| | | | |
|---|---|---|---|
| 2,662,010 | 12/1953 | Ahles | 148/35 |
| 2,762,704 | 9/1956 | Karns | 148/35 |
| 2,867,532 | 1/1959 | Payson et al. | 148/35 |
| 3,367,770 | 2/1968 | Fletcher et al. | 148/35 |
| 3,414,442 | 12/1968 | Greenwood et al. | 148/35 |
| 3,663,214 | 5/1972 | Moore et al. | 148/35 |
| 3,784,416 | 1/1974 | Davies | 148/138 |
| 3,844,844 | 10/1974 | Sato | 148/35 |
| 3,961,994 | 6/1976 | Thome | 148/138 |
| 4,043,842 | 8/1977 | Joiret | 148/138 |

*Primary Examiner*—L. Dewayne Rutledge
*Assistant Examiner*—Peter K. Skiff
*Attorney, Agent, or Firm*—Scully, Scott, Murphy & Presser

[57] ABSTRACT

Forged grinding members of white cast iron containing chromium composed of a solid martensitic or austenitic solution containing a secondary chromium carbides and primary or eutectic chromium carbides of the $M_7C_3$ type, which are finely divided and distributed in a homogeneous manner in the matrix. The grinding members contain from 5 to 15% by weight chromium carbides of the $M_7C_3$ type, i.e. from 2 to 8% chromium.

11 Claims, No Drawings

GRINDING MEMBERS

The invention relates to new grinding members consisting of moderately alloyed ferrous alloy, particularly by, but not exclusively, grinding balls. The invention also relates to a method for the manufacture of these grinding members.

In industry and in particular in the mining industry, various types of forged grinding balls are used, either containing carbon and manganese or having a high content of chromium (8% by weight and above), or a low content of chromium and nickel, in this case with finely dispersed carbides of the $M_3C$ type. Cast balls having a high chromium content or supersaturated with chromium (26% by weight and above) are also used.

It is known that in certain mining applications in particular, grinding balls are subjected to extremely severe abrasive stresses, on the one hand by the materials to be ground of the quartzite type or equivalent and on the other hand, owing to the presence of water or acid products.

Therefore, in the present state of the art, one has chosen either to use very cheap and low strength steels, or very expensive highly alloyed cast irons, or even slightly alloyed cast irons having low resistance to wear.

Thus in their French Pat. No. 73 16163 the applicants proposed new forged grinding members of white cast iron having a high chromium content, the structure of which is constituted by a solid martensitic or austenitic solution containing chromium carbides of the $M_7C_3$ type exclusively, which are finely divided and distributed homogeneously in the solid solution. The carbide content of these grinding members was high (between 15 and 30% by weight), since the applicants estimated that such a quantity of carbides of the $M_7C_3$ type, combined with satisfactory division and distribution of the latter owing to forging, was alone able to ensure excellent resistance to wear of the grinding members.

On account of the increasing cost of the raw materials used for the manufacture of these grinding members, the applicants have been induced to continue their work and they have found that for a given type of carbide (chromium carbides $M_7C_3$), the resistance to wear depends more on their division and distribution in the matrix than on their quantity. More precisely, the applicants have established that it is possible to compensate for the effects of a reduction in quantity of carbides by improving their distribution in the matrix.

The invention therefore intends to propose forged grinding members of white cast iron containing chromium, which have characteristics of resistance to wear comparable with those of grinding members of the prior art, whilst being less expensive than the latter, on account of a reduction in the quantity of carbides which they contain.

The invention also intends to propose a method of manufacture of such grinding members which is simple and inexpensive, whilst ensuring excellent distribution of the carbides in the matrix.

The invention therefore relates to forged grinding members of white cast iron containing chromium, whose structure is composed of a solid martensitic or austenitic solution containing secondary chromium carbides and primary or eutectic chromium carbides of the $M_7C_3$ type, which are finely divided and distributed homogeneously in the matrix, said grinding members being characterised in that they contain from 5 to 15% by weight chromium carbides of the $M_7C_3$ type, i.e. from 2 8% chromium.

In a preferred embodiment of the invention, the said grinding members contain from 1.0 to 3% by weight carbon, from 2 to 8% by weight chromium, from 0 to 2% by weight molybdenum, from 0.5 to 1.5% silicon, from 0.1 to 2% manganese, from 0 to 5% vanadium and from 0 to 1% copper.

These grinding members may also contain special elements, in particular from 0 to 5% by weight tungsten or nickel, from 0 to 1% by weight boron and from 0 to 0.2% by weight niobium, tantalum or zirconium.

The invention also relates to a method for the manufacture of such grinding members, a bar of white cast iron having the desired composition is heated to a first temperature of the order of 900° to 1000° C. allowing hot cutting in the plastic state, said bar is cut into pieces at this first temperature, said pieces are then heated to a second temperature of between 1000° and 1150° C., which is chosen in order to bring about re-austenisation and complete dissolution of the carbides in the austenitic range, said pieces are forged at said second temperature and said pieces are then cooled under conditions suitable for causing the appearance of perlite at the grain boundaries and preferably throughout all the metal.

This perlitic structure of the forged member may be obtained, in manner known per se, by cooling at a controlled speed depending on the composition of the member. It may also be obtained by cooling to a level comprised between 600° and 800° C. and isothermal maintenance of this temperature.

This perlitic structure limits the precipitation of carbides at the joint of the grain and facilitates their subsequent distribution in the course of the thermal treatment which will be applied to the grinding member, for the purpose of adapting its structure to conditions of use and in particular to conditions of abrasion.

As the starting material, one will preferably use a bar manufactured by a method which provides a fine initial structure, for example moulding in a chill mould or continuous casting, with or without refining by ultrasound, with or without electromagnetic stirring. The structure of the bars as cast will be such that it will not comprise any coarse crystallization linked with an excessively high casting temperature.

The composition and combination of the alloy elements of the metal are chosen such that the types of carbide obtained are mainly of maximum hardness, i.e. of the $M_7C_3$ type for chromium carbides, MC for vanadium carbides (possibly with $M_4C_3$) and $Fe_3$ (C,B) for boron carbides; niobium, tantalum and zirconium will have a dispersoid function and will form additional carbides.

This thermal treatment according to the invention thus comprises two stages, one intended to lead to a suitable structure before austenisation, the other to provide a martensitic or austenitic structure.

The first and second temperatures are chosen according to the chemical composition of the initial metal, to give an appropriate structure according to the thermal treatment which will follow.

Methods of the prior art do not attach any importance to cooling after forging, nor to the structure after forging. Now the applicants have found that according to the type of cooling, it is possible to eliminate or limit the precipitation of carbides at the joint of the grain, thus to facilitate the appearance of carbides in the grain itself. This method thus allows maximum and controlled fineness of the distribution of carbides.

This fineness of structure should be maintained in the course of the subsequent thermal treatment applied to the forged ball.

This treatment is intended to adapt its structure to the conditions of abrasion and in all cases involves re-heating the forged ball, which may take place, either from ambient temperature or preferably, in order to save on energy, from the average temperature at which perlite appears, i.e. between 600° and 800° C.

The following example illustrates implementation of the invention.

EXAMPLE

A bar produced by continuous casting is heated to 950° C., the composition by weight of which bar is as follows:

C=1.8 to 2%,
CR=7.2 to 7.5%,
Si=0.7%,
Mn=0.8%,
Cu=0.2%,
B=0.005%.

This bar is cut into pieces at 950° C.

The pieces produced during the cutting operation are re-heated to 1080° C. in a furnace such that they are ejected as soon as the temperature is reached at the centre of the latter.

The pieces are forged at 1060° C., in order to form balls having a diameter of 90 mm, they are then cooled immediately in blown air to a temperature of 700° C. then, cooled further, in still air and loosely. The structure obtained is 80% perlitic. Its hardness is between 400 and 450 BH.

The balls are then treated by being heated to 950° C., followed by oil tempering which gives a martensitic structure having a hardness of 650 BH.

Annealing at a temperature of 490° C. is then carried out, in order to obtain a final hardness of 550 to 600 BH.

The micrographic structure obtained is composed of a solid martensitic solution, containing secondary carbides and eutectic carbides of the $M_7C_3$ type, which are finely divided and distributed in a homogeneous manner.

This distribution is linked with the structure of the bar obtained by continuous casting, with controlled forging and cooling.

The carbide content rises to 11.2% by weight. Their distribution and division are such that their number is greater than 10,000/mm$^2$.

The method according to the invention thus makes it possible to obtain forged balls of white cast iron at limited cost, owing to a reduction in the quantity of chromium, whilst preserving great fineness and a good distribution of the carbides, ensuring good resistance to wear and corrosion.

What is claimed is:

1. A forged grinding member comprising white cast iron containing chromium, the structure of which comprises at least one member of the group consisting of a solid martensitic and austenitic solution, having homogenously distributed therein in finely divided form from 5 to 14% by weight chromium carbides of the $M_7C_3$ type, i.e. from 2 to 7.4% chromium.

2. Grinding members according to claim 1, containing from 1 to 3% by weight carbon, from 2 to 8% by weight chromium, from 0 to 2% by weight molybdenum, from 0.5 to 1.5% silicon, from 0.1 to 2% manganese, from 0 to 5% vanadium and from 0 to 1% copper.

3. Grinding members according to claim 2, additionally containing from 0 to 5% by weight tungsten or nickel.

4. Grinding members according to claim 2, containing from 0 to 1% by weight boron.

5. Grinding members according to claim 2, containing from 0 to 0.2% by weight niobium, tantalum or zirconium.

6. A method of manufacturing a forged grinding member comprising white cast iron containing chromium, the structure of which comprises at least one member of the group consisting of a solid martensitic and austenitic solution, having homogenously distributed therein in finely divided form from 5 to 14% by weight chromium carbides of the $M_7C_3$ type, i.e. from 2 to 7.4% chromium, wherein a bar of white cast iron having the specified composition is heated to a first temperature of the order of 900° to 1000° C. facilitating hot cutting in the plastic state, said bar is cut into pieces at this first temperature, said pieces are heated to a second temperature between 1000° and 1150° C., which is chosen in order to cause re-austenisation and complete dissolution of the carbides in the austenitic range, said pieces are forged at said second temperature, and said pieces are then cooled to cause the appearance of perlite at the grain boundaries.

7. Method according to claim 6, wherein the forged pieces are cooled under conditions causing the appearance of perlite throughout the entire metal.

8. Method according to claim 6, wherein the cooling of the pieces is effected at a controlled rate.

9. Method according to claim 6 wherein the pieces are cooled to a temperature of from 600° to 800° C. and this temperature is then maintained isothermally.

10. Method according to claim 6 wherein said bar of white cast iron has a fine structure and contains carbides of the $M_7C_3$ type for chromium, of the MC type and possibly $M_4C_3$ type for vanadium, of the MC type for niobium, tantalum and ziroconium and $Fe_3$ (C, B) for boron.

11. Method according to claim 6 wherein the forged pieces of perlitic structure obtained are then subjected to re-heating.

* * * * *